US006121559A

United States Patent [19]

Bassin

[11] Patent Number: 6,121,559

[45] **Date of Patent: *Sep. 19, 2000**

[54] BELLOWS

[76] Inventor: Gilbert Bassin, c/o Pres:Air:Trol Corporation 1009 W. Boston Post Rd., Mamaroneck, N.Y. 10543

[ * ] Notice: This patent is subject to a terminal disclaimer.

[21] Appl. No.: 09/374,858

[22] Filed: Aug. 16, 1999

Related U.S. Application Data

[63] Continuation-in-part of application No. 08/888,146, Jul. 3, 1997, Pat. No. 5,962,826.

[51] Int. Cl.[7] ..... H01H 35/34

[52] U.S. Cl. ..... 200/81 H; 92/5 R; 200/832

[58] Field of Search ..... 200/83 RCZ, 81 H, 200/302.1, 302.2; 340/513, 626; 73/861.44, 861.47, 729.1; 307/118; 116/220, 264, 266, 277; 92/5 R, 34, 36; 91/1

[56] References Cited

U.S. PATENT DOCUMENTS

| | | |
|---|---|---|
| 3,300,604 | 1/1967 | Straub . |
| 3,710,314 | 1/1973 | Bell . |
| 3,900,710 | 8/1975 | Potter . |
| 4,647,738 | 3/1987 | Diamond . |
| 4,754,107 | 6/1988 | Tracey . |
| 4,894,652 | 1/1990 | Eckstein . |
| 5,155,309 | 10/1992 | Dwyer . |
| 5,461,207 | 10/1995 | Van Lear . |
| 5,728,984 | 3/1998 | Miller . |
| 5,743,555 | 4/1998 | Durrani . |
| 5,962,826 | 10/1999 | Bassin . |

FOREIGN PATENT DOCUMENTS

| | | | |
|---|---|---|---|
| 636954 | 4/1928 | France | 200/83 Z |
| 2717472 | 11/1977 | Germany | 200/83 Z |
| 2717488 | 11/1977 | Germany | 200/83 Z |

*Primary Examiner*—Gerald Tolin
*Attorney, Agent, or Firm*—William E. Pelton; Donald S. Dowden; Cooper & Dunham LLP

[57] ABSTRACT

A bellows has a first portion that is formed with a hollow protrusion and can be actuated by pressing on it and a second portion formed with an annular wall defining an opening. The hollow protrusion fits within the opening. Actuation of the first portion causes a fluid to flow through the hollow protrusion and opening, and the fluid tends to force the protrusion against the annular wall. In another embodiment, the first and second portions are sealed along planer front and rear walls. A nut us provided having teeth for clamping the device to an air tube. The bellows can be used to control any device, including a pressure switch, valve or gauge, that is controlled by a change in fluid pressure applied thereto.

12 Claims, 7 Drawing Sheets

BELLOWS

CROSS REFERENCE TO RELATED APPLICATIONS

This is a continuation in part of parent application Ser. No. 08/888,146, now U.S. Pat. No. 5,962,826, filed Jul. 3, 1997, for "Bellows". The priority of the parent application is claimed in the present application under 35 U.S.C. Section 120.

BACKGROUND OF THE INVENTION

1. Field of the Invention

This invention relates to bellows and, more particularly, to a novel and highly effective bellows especially adapted for actuating any device controllable by a change in fluid pressure applied thereto. The construction of the bellows is such that it has a greatly extended mean time between failures (MTBF).

2. Description of the Prior Art

In many environments, it is not safe to employ an electrical switch or other device controllable by a change in fluid pressure applied thereto. For example, because of the risk of an electrical shock or even electrocution, occupants of a hot tub or sauna cannot safely operate an electrical switch. In such environments, it is customary to employ a pneumatic device that operates in response to manual pressure (the term used herein refers to pressure applied not only by a hand by also by a foot or in any other way) to send a pressure pulse to a pressure switch mounted at some distance from the hot tub or sauna. The pressure switch (momentary or latching) can in turn control electrical apparatus for controlling valve positions, pump motors, temperature settings, etc.

FIG. 1 shows conventional structure. A bellows 10 comprises a first portion 12 that is flexible and a second or base portion 14 that is rigid. The base portion 14 is disk-shaped. The flexible portion 12 has an open end 16 formed with an annular groove 18 that accommodates the periphery of the disk-shaped base 14. An annular bead of glue 20 or other adhesive is applied to the junction between the periphery of the disk 14 and the annular groove 18 in order to form an airtight seal.

The device is actuated manually. For example, when a digit D such as a thumb or a finger of an operator presses on the flexible part 12 to depress it from the position shown in solid outline in FIG. 1 to the position shown in broken outline, a pressure pulse passes through an extension 22 extending away from the base 14 on the side thereof opposite the flexible part 12. The extension 22 is formed with a nipple 24 and an annular recess 26. A hollow air tube 28 fits over the nipple 24 and is received in the recess 26. The extension 22 has an air passage 30 that communicates with the space 32 enveloped by the flexible portion 12 and the disk 14 and that communicates also with the air tube 28. This delivers a pressure pulse to a pressure switch 32, which operates in a conventional manner to control a valve or perform some other desired function.

One problem with this conventional structure is that, when the digit D depresses the flexible portion 12 from the position shown in solid outline in FIG. 1 to the position shown in broken outline, the increased air pressure that results within the space 32 is transmitted throughout the space, applying an outward force on the part of the flexible portion 12 that is joined to the base 14 and tending to flex and disrupt the seal formed by the glue 20. Also, mechanical transmission of force from the digit D through the wall of the portion 12 to the area seal tends to flex and disrupt the seal. After a number of cycles of operation the bellows may fail. Another problem is that the tube 28 may become detached from the nipple 24, as when the device is withdrawn from a wall for inspection or repair.

OBJECTS AND SUMMARY OF THE INVENTION

An object of the invention is to remedy the problems of the prior art outlined above and in particular to provide a new and improved bellows that has a greatly extended MTBF and that is easier to inspect and repair.

The foregoing and other objects are attained in accordance with a first aspect of the invention by providing a device controllable by a change in fluid pressure applied thereto, a hollow tube, an actuator for the device comprising means for generating a pressure pulse and a hollow nipple inserted into the hollow tube, and a toroidal nut. The hollow tube has an upstream end connected to the actuator and a downstream end connected to the device, and the nut is formed with means clamping at least one of (a) the upstream end of the hollow tube onto the nipple and (b) the downstream end of the hollow tube onto the device. Upon actuation of the actuator, the hollow tube delivers the pressure pulse to the device to control the device.

In accordance with an independent aspect of the invention, there is provided an apparatus comprising a manually depressible actuator, a device controllable by a change in fluid pressure applied thereto, and a conduit connecting the actuator and the device. The actuator and the conduit contain a fluid. The actuator is formed with a rigid portion and a flexible hollow protrusion fitting within and not extending beyond the rigid portion and forming a seal therewith. The construction is such that manual depression of the actuator causes a fluid pulse to travel through the conduit to control the device and tends to force the protrusion against the rigid portion, thereby avoiding any tendency for the pressure pulse to degrade the seal.

In accordance with another independent aspect of the invention, there is provided an apparatus comprising an actuator, a device controllable by a change in pressure, and a conduit connecting the actuator and the pressure switch. The actuator and the conduit contain a fluid for transmitting a pressure pulse from the actuator to control the device. A torodial nut fits around the conduit adjacent at least one of (a) the actuator and (b) the pressure switch. The torodial nut is formed with means for clamping the conduit when the nut is tightened, thereby preventing separation of said conduit from said one of the actuator and the device.

In accordance with the invention as summarized above, actuation of the bellows has no tendency to break the seal between the two parts of the bellows. In fact, in one embodiment of the invention, the fluid tends to expand the flexible protrusion so that it is forced even more tightly against the rigid annular wall.

The apparatus of the invention preferably comprises a number of additional features, including a novel way of incorporating a message that particularly adapts the bellows for use with vending message that particularly adapts the bellows for use with vending machines and elevators.

The apparatus of the invention can be used wherever it is desired to deliver a pressure pulse or a puff of air, as in inflating balloons, sphygmomanometers and medical cuffs of all kinds, in balloon angioplasty, and in leg compression apparatus to aid blood flow.

BRIEF DESCRIPTION OF THE DRAWINGS

A better understanding of the objects, features and advantages of the invention can be gained from the following detailed description of the preferred embodiments thereof, in conjunction with the appended figures for the drawing, wherein.

DESCRIPTION OF THE PREFERRED EMBODIMENTS

Figure 2:
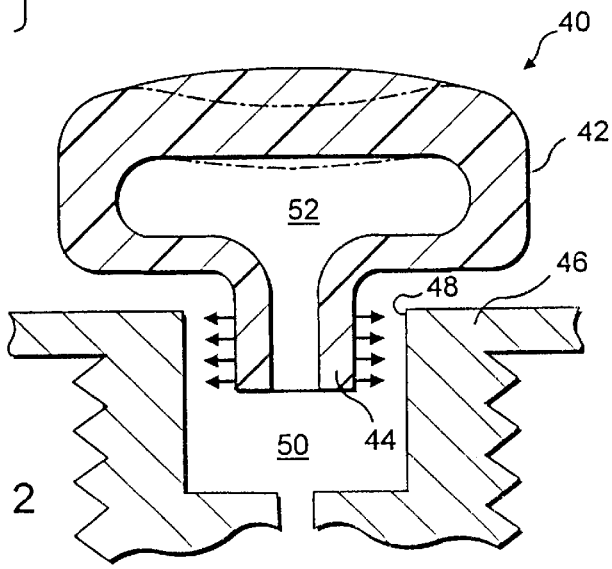
FIG. 2 is a sectional view in elevation of illustrating a principle of one embodiment of the invention.
Figure 3:
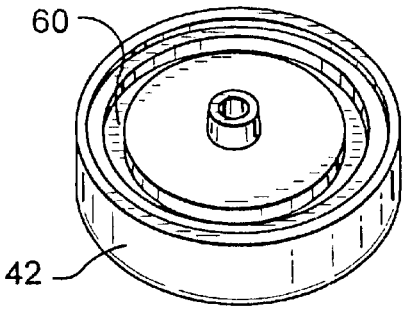
FIG. 3 is a perspective view from the rear of one embodiment of the structure in accordance with the invention.
Figure 4:
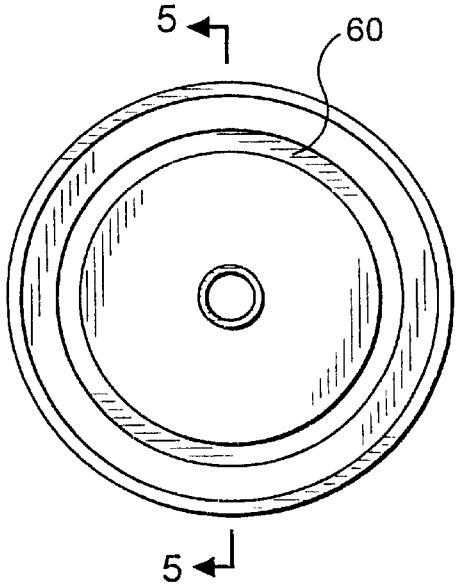
FIG. 4 is a rear plan view of the structure of FIG. 3.
Figure 5:
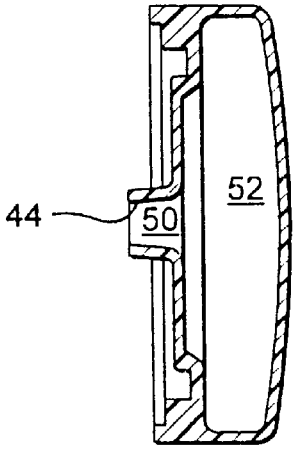
FIG. 5 is a sectional view taken along the line 5—5 of FIG. 4 and looking in the direction of the arrows.
Figure 6:
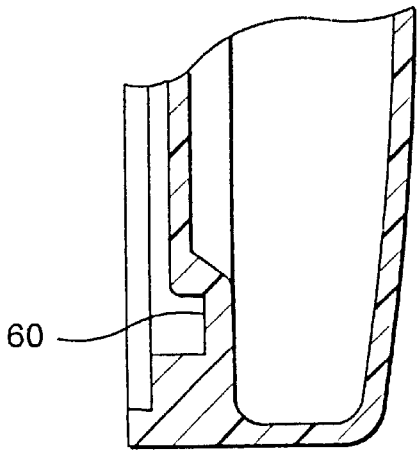
FIG. 6 is an enlarged view of a portion of the structure of FIG. 5.
Figure 7:
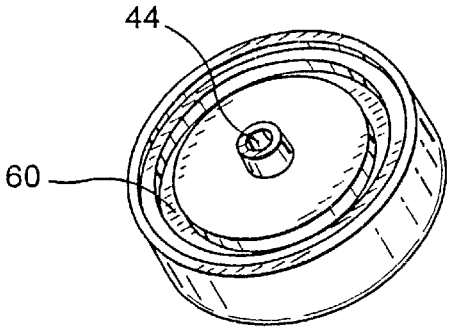
FIG. 7 is a perspective view from the rear of another embodiment of structure in accordance with the invention.

FIG. 2 shows a bellows 40 comprising a first portion 42 that is formed with a hollow protrusion 44 and can be actuated by pressing on it. The bellows further comprises a second portion 46 formed with an annular wall 48 defining an opening 50. The hollow protrusion 44 fits within the opening 50. Actuation of the first portion 42 by application of manual pressure, for example, causes a fluid to flow, or a pressure pulse to be transmitted, through the hollow protrusion 44 and opening 50, and the fluid tends to force the protrusion 44 against the annular wall 48.

The first portion 42 is preferably formed at least in part of a flexible material such as rubber. The material may also be stretchable. However, it is also within the scope of the invention to provide a rigid material articulated to allow a part of it to move so as to compress fluid contained within the portion 42.

The hollow protrusion 44 is also preferably formed at least in part of a flexible material. The second portion 46 is preferably formed at least in part of a rigid material. At least the annular wall 48 should be formed of a rigid material. It is within the scope of the invention, however, to form the second portion 46 at least in part of a flexible material. In a preferred embodiment of the invention, the first portion 42 is flexible in its entirety and the second portion 46 is rigid in its entirety.

The first portion 42 enclosed a volume 52 of fluid, typically air.

Figure 1:
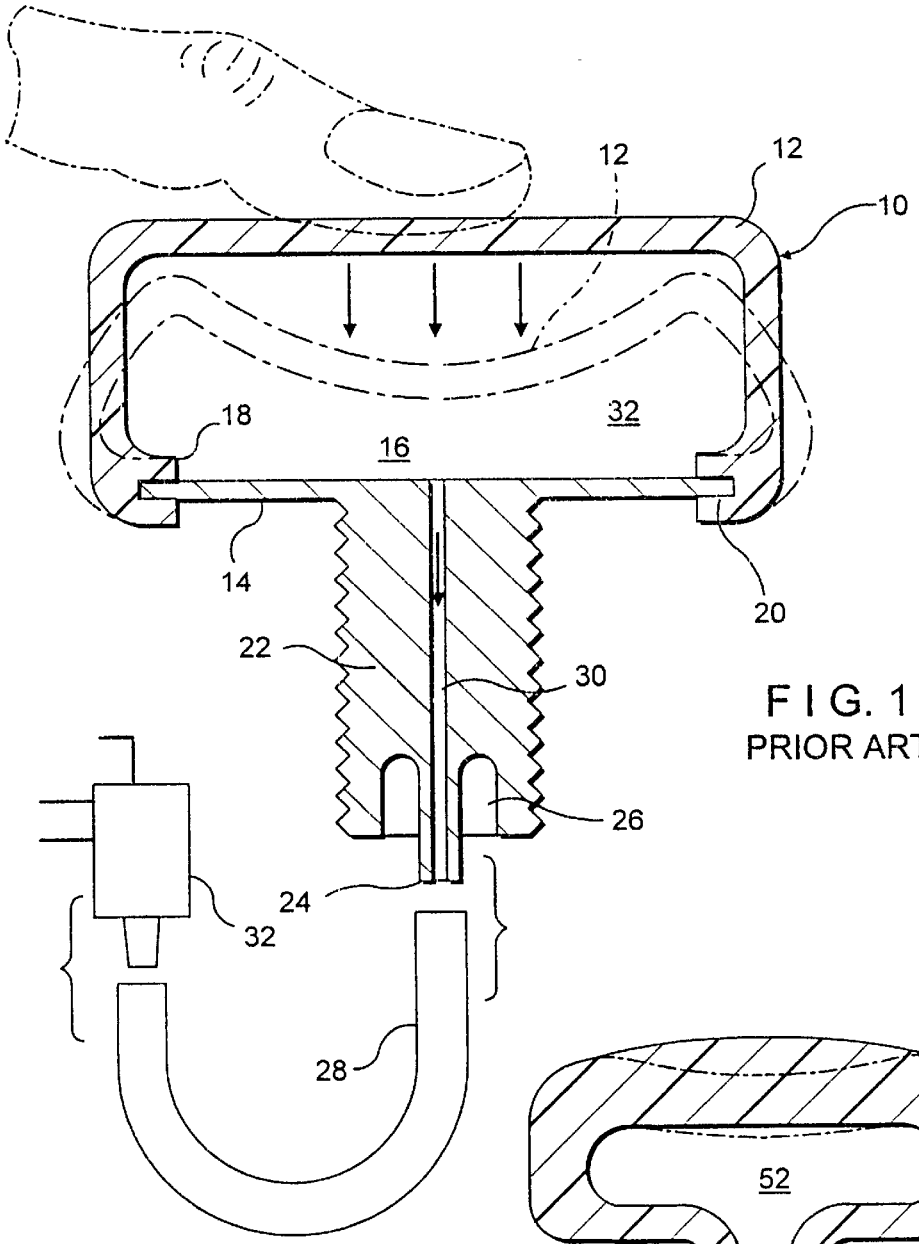
F I G. 1 PRIOR ART
FIG. 1 is a sectional view in elevation of a conventional bellows.

As FIG. 1 shows, the air switch 32 and air tube 28 can be connected to the structure of FIG. 2, whereby actuation of the first portion 42 causes a pressure pulse to pass through the hollow protrusion 44, the opening 50, and the tube 28 to actuate the pressure switch 32. In accordance with the invention, any device controllable by a change in fluid pressure can be substituted for the pressure switch 32. Such devices include valves and gauges, and item 32 can be considered to represent any such device.

As FIGS. 3–6 show, the first portion 42 can be formed with a groove 60 adapted to accommodate a corresponding rib on the base 46. The entire structure can be mounted in a wall (in a hot tub, physician's office, clinic, vending machine, elevator, etc.).

Figure 8:
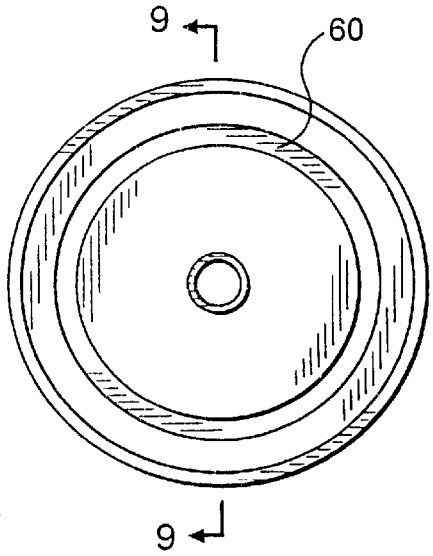
FIG. 8 is a rear plan view of the structure of FIG. 7.
Figure 8A:
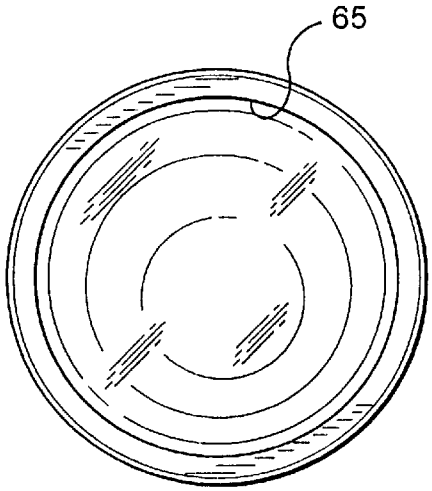
FIG. 8A is a front plan view of the structure of FIG. 7.
Figure 9:
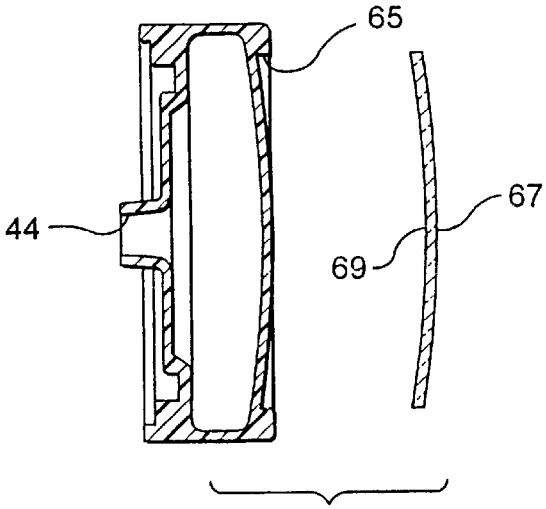
FIG. 9 is a sectional view along the line 9—9 of FIG. 8 and looking in the direction of the arrows.

FIGS. 7–10 and 8A correspond generally to FIGS. 3–6 but show another embodiment of the invention wherein an undercut portion 65 is provided for retaining a transparent disk 67. FIG. 8A shows the front side of the structure of FIG. 9. The disk 67 has rear side 69 on which reverse writing can be imprinted. When the disk 67 is retained by the undercut portion 65, the reverse writing on the disk 69 can be viewed in a normal manner from the front side of the transparent disk. At the same time, the writing or other message is protected from the outside so that it is not damaged by the atmosphere, soiled hands, etc. Thus the invention is ideally suited for use in making selections in vending machines, on elevators, etc.

Figure 10:
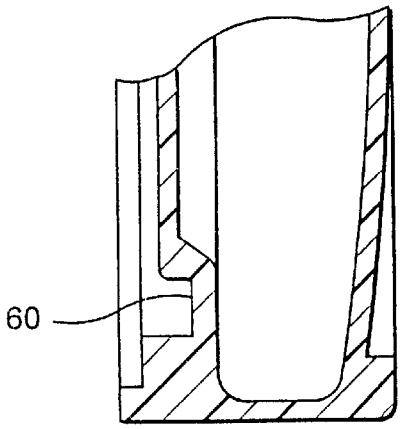
FIG. 10 is an enlarged view of a portion of the structure of FIG. 9.
Figure 10A:
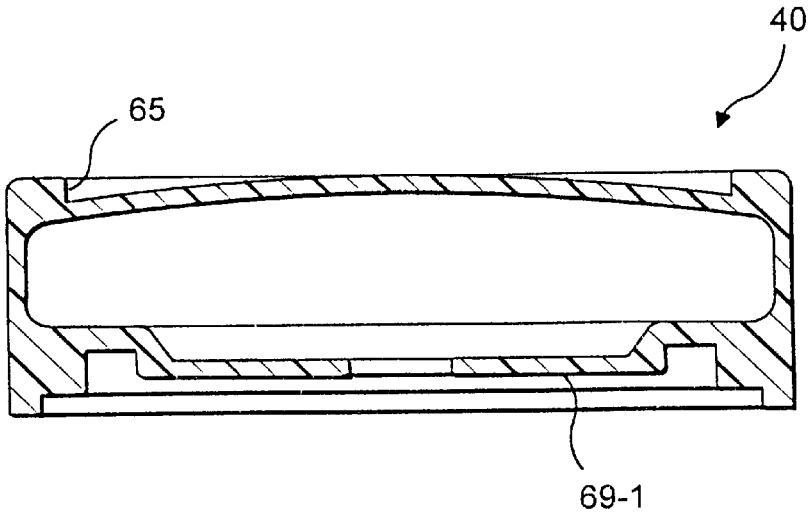
FIG. 10A is a sectional view in elevation of a first portion of another embodiment of the invention.

FIG. 10A is a sectional view in elevation of a first portion of another embodiment of the invention. This embodiment is characterized by a flat rear surface 69-1. It also has an undercut portion 65 for accommodating a disk 67 as described above. No protrusion corresponding to the protrusion 44 of FIG. 2 is needed in this embodiment of the invention.

Figure 10B:
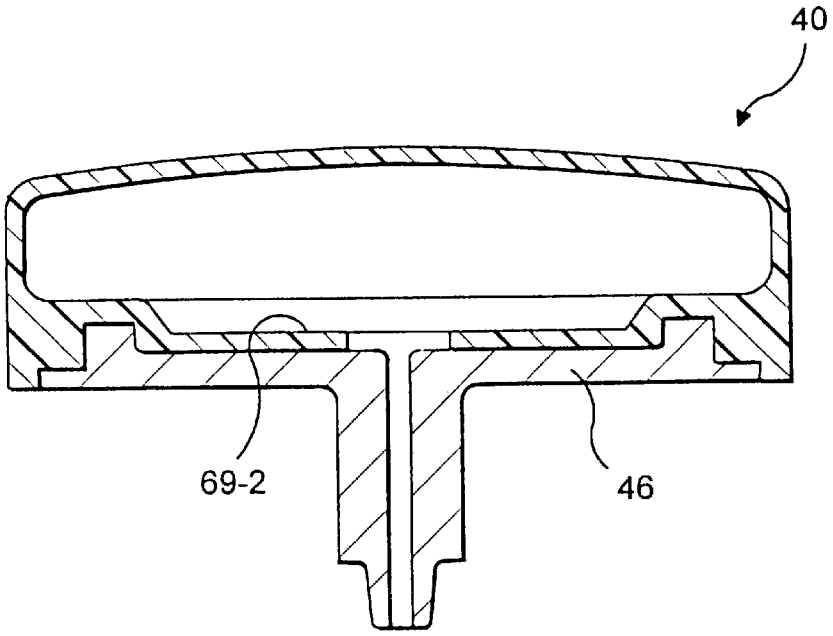
FIG. 10B is a sectional view in elevation of a modification of the structure of FIG. 10A assembled with a second portion of an embodiment of the invention.
Figure 11:
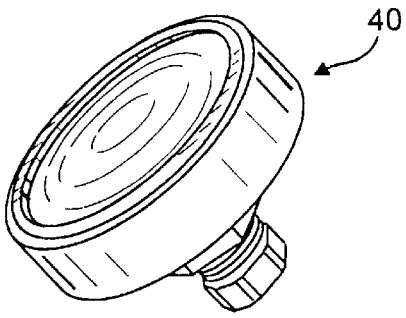
FIG. 11 is a perspective view from the front showing another feature of the invention.
Figure 12:
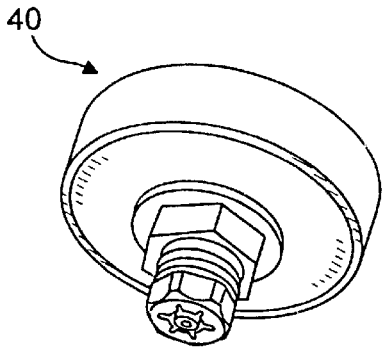
FIG. 12 is a perspective view from the rear of the structure of FIG. 11.
Figure 13:
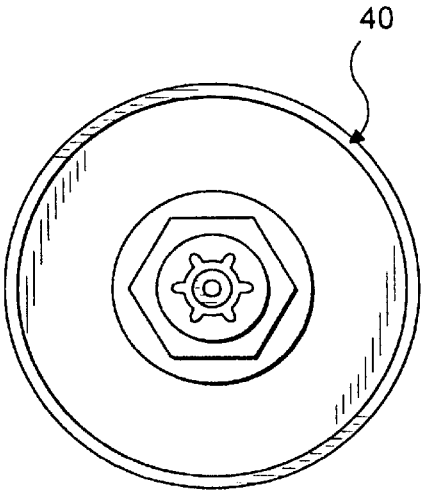
FIG. 13 is a rear plan view of the structure of FIGS. 11 and 12.
Figure 14:
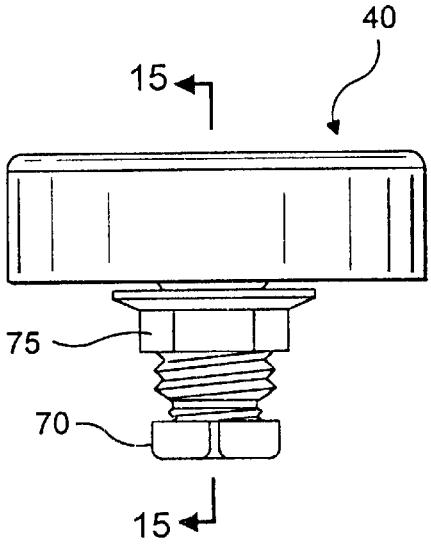
FIG. 14 is a view in elevation of the same structure.
Figure 15:
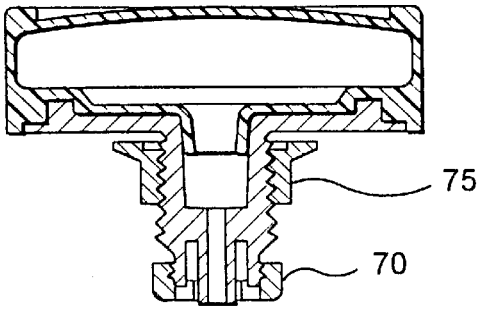
FIG. 15 is a sectional view along the line 15—15 of FIG. 14 and looking in a direction of the arrows.
Figure 16:
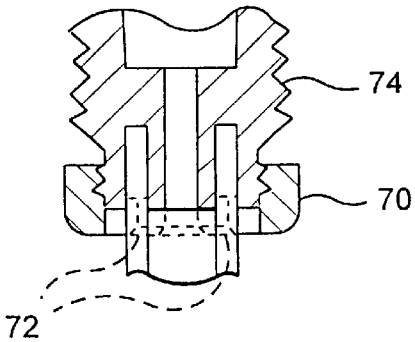
FIG. 16 is an enlarged view of a portion of the structure of FIG. 15.

FIG. 10B is a sectional view of a modification of the structure of FIG. 10A assembled with a second portion of an embodiment of the invention. The structure 46 of FIG. 10B has a planar surface 69-2 that mates with the surface 69-1. Glue can be employed as a sealant over the planar surfaces where they meet. When a pressure pulse is generated by pressing in the first portion 40, there is no tendency for the pulse to flex the seal made by the glue, and the seal thus holds up very well. The structure of FIG. 10B has a smooth top and is not adapted for holding a disk with reverse-printed writing.

FIGS. 11–16 show structure similar to the structure shown in FIGS. 7–10 but also show a nut 70 having inwardly directed teeth 72 that clamp the air tube 28 (FIG. 1) securely. The nut 70 is attached to an extension 74 of the base 46. Thus when the switch actuator 40 is withdrawn from the front side, the base 46 brings the extension 74 with it. Since the nut 70 is attached to the extension 74, and since the nut 70 securely anchors the air tube 28, the air tube 28 is also withdrawn. In the absence of the invention, the air tube 28 sometimes becomes detached when the switch actuator is withdrawn from the front. This makes it necessary to retrieve it from the front side using, for example, long-nose pliers. The invention addresses this problem in a novel and highly efficient manner. A nut 75 is provided for mounting the unit on a wall. A similar arrangement including especially a nut like nut 70 can be used to secure the downstream end of the air tube to the pressure switch or other device with which it cooperated.

Figure 17:
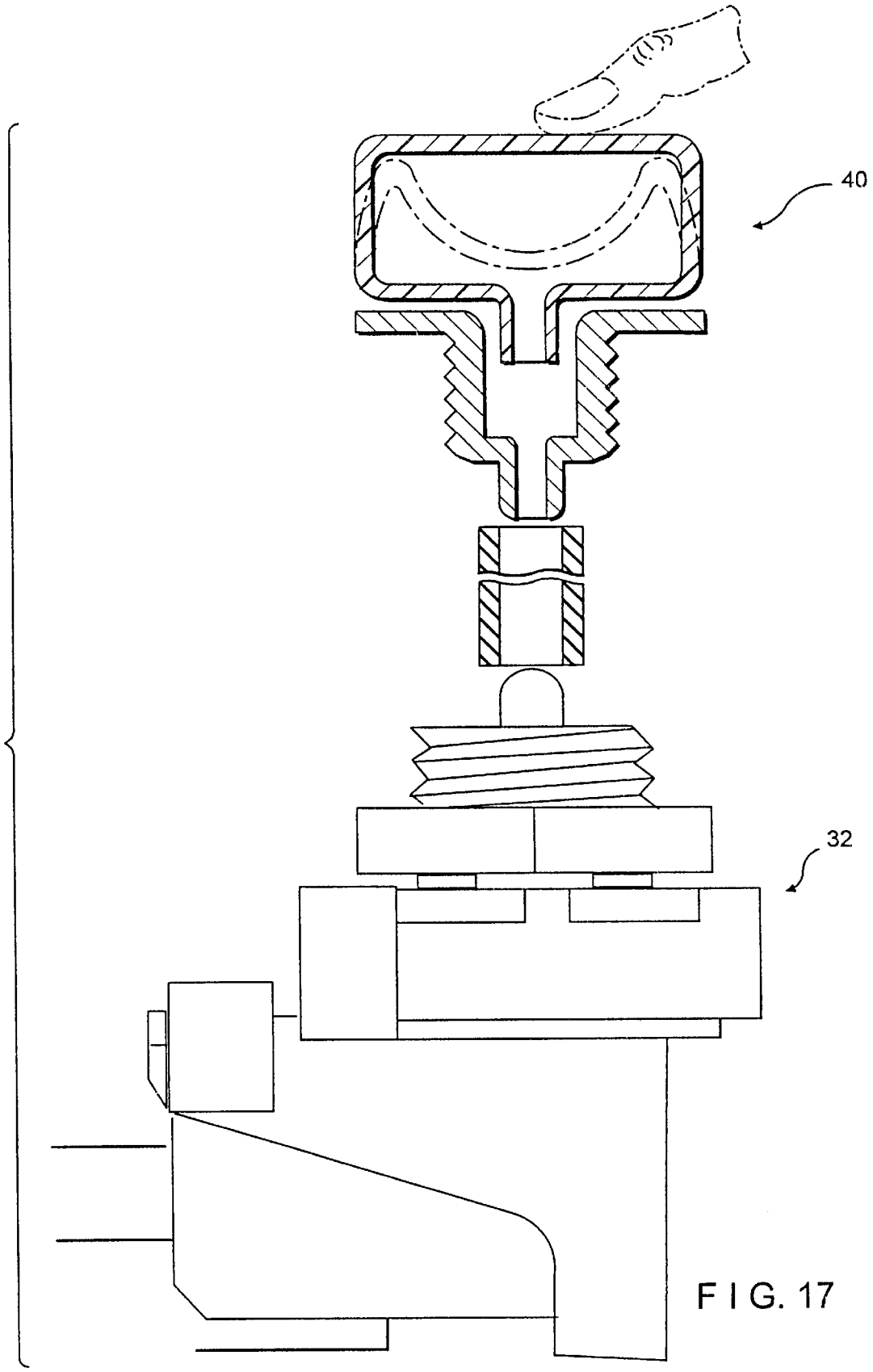
FIGS. 17 and 18 are schematic views showing representative applications of the invention.
Figure 18:
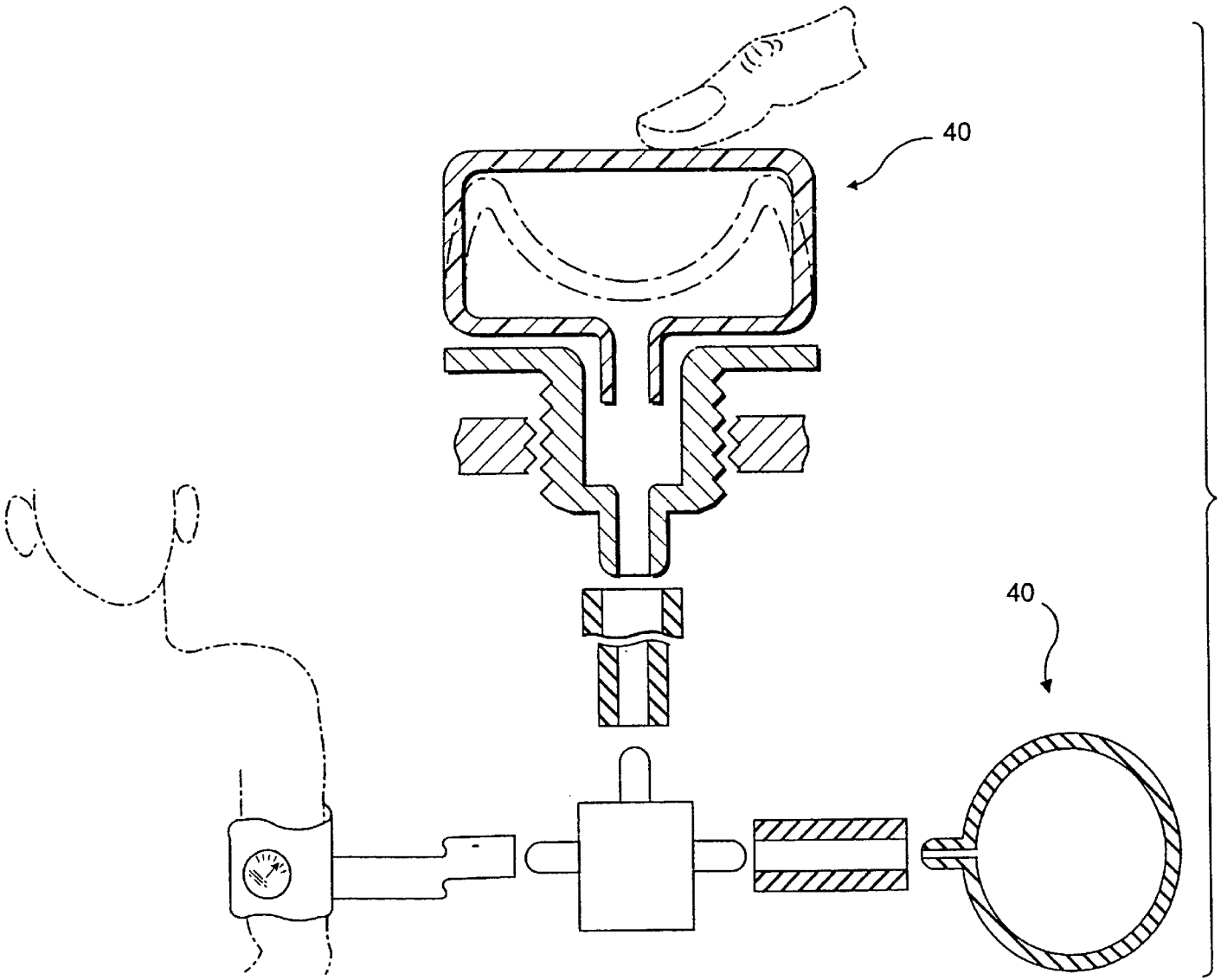

FIGS. 17 and 18 are schematic views showing applications of the invention. FIG. 17 shows the invention employed to operate a pressure switch. FIG. 18 shows the invention employed to inflate a sphygmomanometer cuff or, alternatively, a balloon. For inflation, a conventional check valve and air intake are employed.

Thus there is provided in accordance with the invention a novel and highly effective apparatus that remedies the problems of the prior art noted above and accomplishes the objects of the invention set out above. Many modifications of the preferred embodiments of the invention disclosed herein will readily occur to those skilled in the art. The invention is to be construed as including all such modifications as fall within the scope of the appended claims.

I claim:

1. In combination, a device controllable by a change in fluid pressure applied thereto, a hollow tube, an actuator for the device comprising means for generating a pressure pulse and a hollow nipple inserted into the hollow tube, and a toroidal nut, wherein, the hollow tube has an upstream end connected to the actuator and a downstream end connected to the device, and the nut is formed with means clamping at least one of (a) the upstream end of the hollow tube onto the nipple and (b) the downstream end of the hollow tube onto the device; whereby upon actuation of the actuator, the hollow tube delivers the pressure pulse to the device to control the device.

2. A combination according to claim 1 wherein the clamping means comprises a plurality of teeth engaging with the upstream end of the hollow tube at spaced-apart intervals around the tube.

3. An apparatus comprising a manually depressible actuator, a device controllable by a change in fluid pressure applied thereto, and a conduit connecting the actuator and the device, wherein the actuator and the conduit contain a fluid, the improvement wherein, the actuator is formed with a rigid portion and a flexible hollow protrusion fitting within and not extending beyond the rigid portion and forming a seal therewith, the construction being such that manual depression of the actuator causes a fluid pulse to travel through the conduit to control the device and tends to force the protrusion against the rigid portion, thereby avoiding any tendency for the pressure pulse to degrade the seal.

4. Apparatus according to claim 3 wherein the fluid is air.

5. Apparatus according to claim 3 wherein the actuator is formed with a retainer, further comprising a label secured by the retainer.

6. Apparatus according to claim 5 wherein the retainer is formed as an undercut annulus and the label is formed as a disk retained by the annulus.

7. Apparatus according to claim 6 wherein the disk is at least in part transparent and has a print side facing towards the rigid portion and an outside facing away from the rigid portion.

8. Apparatus according to claim 7 further comprising a message printed in reverse in the print side for viewing through the transparent part of the disk.

9. In apparatus comprising an actuator, a device controllable by a change in pressure, and a conduit connecting the actuator and the device, wherein the actuator and the conduit contain a fluid for transmitting a pressure pulse from the actuator to control the device, the improvement comprising a torodial nut fitting around the conduit adjacent at least one of (a) the actuator and (b) the pressure switch, the torodial nut being formed with means for clamping the conduit when the nut is tightened, thereby preventing separation of said conduit from said one of the actuator and the device.

10. Apparatus according to claim 9 wherein the clamping means comprising a plurality of inwardly directed teeth engageable with the conduit when the nut is tightened.

11. Apparatus comprising a fluid conduit;

a flexible bellows having a rigid portion and a hollow protrusion extending within said rigid portion and forming a seal with the inner walls thereof, whereby actuation of said flexible bellows tends to force said hollow protrusion against in the inner walls of said rigid portion thereby enhancing the seal; and a device that is controllable by a change in fluid pressure applied thereto and that is connected to said conduit in spaced-apart relation to said bellows, whereby said bellows can be used to control said device.

12. Apparatus according to any of the preceding claims wherein the device is selected from the group consisting of valves and gauges.

* * * * *